US007328714B2

(12) United States Patent
Wu

(10) Patent No.: US 7,328,714 B2
(45) Date of Patent: Feb. 12, 2008

(54) TANGLE-FREE UMBRELLA GRIP ADAPTED FOR HANGING TO A CLOSED ITEM

(76) Inventor: Tsun-Zong Wu, PO Box 82-144, Taipei (TW)

( * ) Notice: Subject to any disclaimer, the term of this patent is extended or adjusted under 35 U.S.C. 154(b) by 286 days.

(21) Appl. No.: 11/016,947

(22) Filed: Dec. 21, 2004

(65) Prior Publication Data

US 2006/0144431 A1 Jul. 6, 2006

(51) Int. Cl.
*A45B 25/00* (2006.01)
*A45B 19/08* (2006.01)
*A45B 9/02* (2006.01)

(52) U.S. Cl. ..... 135/15.1; 135/25.4; 294/171; 16/111.1

(58) Field of Classification Search ..... 135/15.1, 135/25.4, 76, 16; 280/819, 821, 822; 473/301–303; 294/171; 16/DIG. 25, 442, 111.1; *A45B 9/02*
See application file for complete search history.

(56) References Cited

U.S. PATENT DOCUMENTS 2,166,562 A * 7/1939 Staley ..... 135/15.1
4,616,868 A * 10/1986 Okuda ..... 294/137
4,624,276 A * 11/1986 Allen ..... 135/25.4
4,632,137 A * 12/1986 Exley et al. ..... 135/15.1
4,907,614 A * 3/1990 Stamm ..... 135/15.1
6,052,868 A * 4/2000 Chen ..... 16/110.1
6,694,666 B2 * 2/2004 Iwabuchi ..... 43/25

FOREIGN PATENT DOCUMENTS

JP 11042108 A * 2/1999

* cited by examiner

*Primary Examiner*—David Dunn
*Assistant Examiner*—Tania Abraham
(74) *Attorney, Agent, or Firm*—Leong C. Lei

(57) ABSTRACT

A grip for an umbrella is provided on an outer wall with a through hole; at least one annular groove having a start point communicating with the through hole and a terminal point; a hook located at the terminal point of the groove; and an elastic strap having an inner end pressing against an inner side of the through hole, and an outer end outward extended through the through hole to form a loop portion having a turning section. The elastic strap could be wound around the groove with the turning section engaged with the hook, and is therefore prevented from tangling other articles in a container holding the umbrella that is not in use. Or, the elastic strap may be extended through a closed item with the turning section engaged with the hook to thereby externally hang the umbrella not in use to the closed item.

4 Claims, 3 Drawing Sheets

TANGLE-FREE UMBRELLA GRIP ADAPTED FOR HANGING TO A CLOSED ITEM

BACKGROUND OF THE INVENTION (a) Technical Field of the Invention

The present invention relates to an umbrella grip, and more particularly to an umbrella grip that allows an umbrella to be positioned in a container or the like without the trouble of tangling other items in the container, or be externally hung to any closed item.

(b) Description of the Prior Art

Most people would usually carry an umbrella along with them when going out on a cloudy or rainy day for use at any time.

To enable convenient carrying of an umbrella, particularly a small-sized folding umbrella, a strap is usually provided on a grip of the umbrella to project therefrom and form a closed loop for gripping with fingers.

To carry the umbrella, it would usually occupy a user's one hand. In the event the user has to do something with two hands, such as carrying a baby or picking up something during shopping, the umbrella would inevitably form an inconvenience and confusion to the user.

Therefore, it is preferably a folded or collapsed umbrella be positioned in a bag or the like carried along with the user or externally hung to the carried bag or something near at hand when the umbrella is not in use. In this way, the user may have two hands free for use. In the case of a wetted umbrella, it is usually externally hung to the carried bag to avoid wetting other items in the bag.

When it is desired to take out a pocket or mini umbrella having such a strap from something carried along with the user, such as a handbag, it is very possible a loop portion of the strap tangles other small items, such as cosmetics, in the handbag to embarrass the user or cause inconvenience to the user.

A user at home may easily hang the umbrella on a wall surface or a clothes tree in the house by winding the loop portion of the strap on a generally open-topped hook on the wall or the clothes tree. However, such hook is not always available at other public spaces. Therefore, there are times the user fails to find something suitable for conveniently hanging the umbrella at any time. And, it is almost impossible to hang the umbrella to a closed item, such as a top handle of the user's handbag or a nearby chair frame, via the conventional strap that provides a closed loop portion.

It is therefore desirable to have an umbrella that could be positioned in a container or the like, such as a handbag, carried along with the user without tangling other things in the handbag, or be externally hung to a closed item at any time as necessary.

U.S. Pat. No. 4,616,868 discloses an umbrella grip with a tying string formed into a loop. The umbrella grip does not include any retraction mechanism or winding design for retracting the loop of the tying string inwardly into the grip or winding the loop on outer surface of the grip when the use of the tying string is not desired. The protruded loop of the tying strip tends to tangle other small items in a handbag or the like, in which the umbrella not in use is positioned, and therefore causes troubles in taking the umbrella out of the handbag or the like. Moreover, since the loop of the tying string is a closed loop that could not be arbitrarily opened, it is impossible to hang the umbrella to a closed item via the closed loop when the umbrella is not in use.

U.S. Pat. No. 4,632,137 discloses an umbrella grip with a rigid retaining ring. When the umbrella is not in use, the retaining ring is fixedly held in a recess provided on the grip and prevented from tangling other items. However, the retaining ring is also a closed ring member that could not be put around a closed item to hang the umbrella thereto.

U.S. Pat. No. 4,624,276 discloses an umbrella grip having a fastening element. When the umbrella is not in use, the fastening element is wound around an annular groove provided on the grip without tangling other things. However, the fastening element has two closed ends and could not be put around any closed item for hanging thereto.

SUMMARY OF THE INVENTION

The primary purpose of the present invention is to provide a tangle-free umbrella grip adapted for hanging to a closed item.

To achieve the above and other objects, the tangle-free umbrella grip of the present invention mainly includes a grip, a hook, and an elastic strap. The grip is formed at an outer periphery with a circumferentially extended wall, and has a through hole extended through the wall. The grip is circumferentially provided on the wall with at least one groove, which has a start point communicating with the through hole and a terminal point. The hook is located at the terminal point of the at least one groove on the grip. And, the elastic strap has an inner end pressing against an inner side of the through hole on the grip, and an outer end outward extended through the through hole to form a loop portion protruded from the grip. The loop portion includes a first strap section, a second strap section, and a turning section located between and integrally connecting the first and second strap sections together.

The elastic strap is adapted to wind around the grip with the first and the second strap section elastically and fitly lying in the at least one groove and the turning section engaged with the hook, allowing the umbrella to be positioned in a container or the like without tangling the elastic strap with other articles in the container.

Alternatively, the elastic strap could be hung to a closed item by extending the elastic strap through the closed item and then engaging the tuning section at the outer end of the elastic strap with the hook on the grip.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
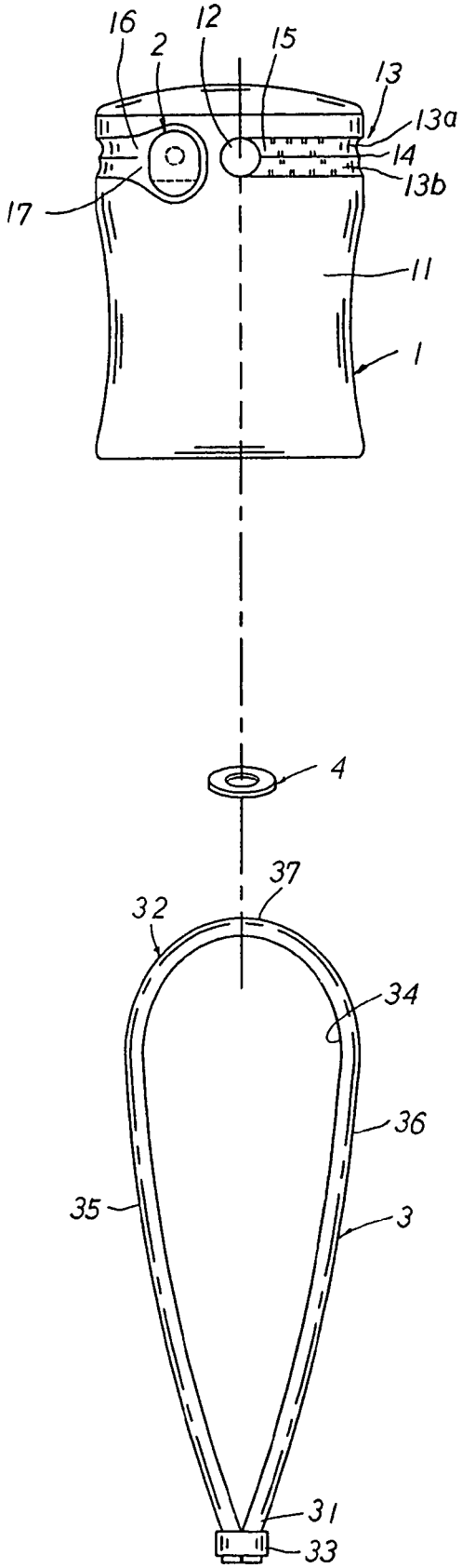
FIG. 1 is an exploded front view of a tangle-free umbrella grip adapted for hanging to a closed item according to a first embodiment of the present invention.
Figure 2:
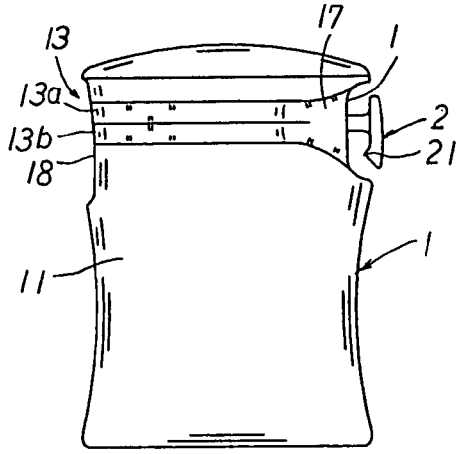
FIG. 2 is a side view of the tangle-free umbrella grip of the present invention shown in FIG. 1.
Figure 3:
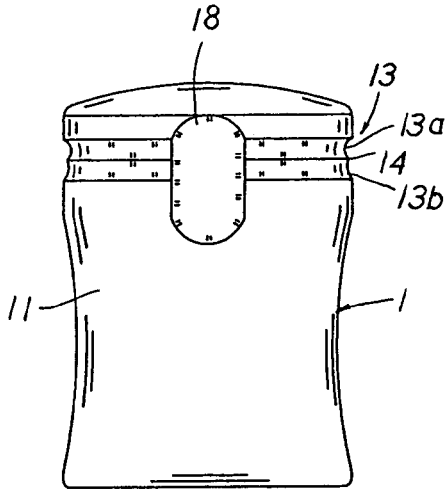
FIG. 3 is a rear view of the tangle-free umbrella grip of the present invention shown in FIG. 1.

Please refer to FIGS. 1, 2, and 3 in which a tangle-free umbrella grip adapted for hanging to a closed item according to a first embodiment of the present invention is shown. As shown, the tangle-free umbrella grip of the present invention mainly includes a grip 1, a hook 2, and an elastic strap 3.

The grip 1 is coaxially connected to a central shaft (not shown) to form an umbrella. Since the present invention is particularly related to the umbrella grip and the strap thereof, descriptions about other components other than these two items are omitted from the specification.

Although not particularly mentioned, the umbrella grip and the strap thereof according to the present invention are applicable for various types of umbrellas, including, for example, folding umbrella, stick umbrella, self-opening umbrella, and hand-opening umbrella.

The grip 1 illustrated in the first embodiment is formed as a cylindrical shape commonly adopted in folding umbrellas. However, the grip 1 of the present invention may be of any shape without limitation. For example, a rectangular shape or other shapes may also be modified from the cylindrical grip.

The grip 1 is formed at an outer periphery with a circumferentially extended wall 11, and a through hole 12 extended through the wall 11. The grip 1 is circumferentially provided on the wall 11 with at least one annular groove 13. In the illustrated first embodiment of the grip 1, there are two circumferentially, coaxially, and juxtapositionally arranged grooves, namely, first and second grooves 13*a*, 13*b*, with a boundary ridge 14 located between them. The at least one groove 13 has a start point 15 and a terminal point 16. The start point 15 is communicating with the through hole 12, and the terminal point 16 may be in contact with or separated from the start point 15. In the illustrated first embodiment of the grip 1, the terminal point 16 is separated from the start point 15. That is, the groove 13 or grooves 13*a*, 13*b* are not necessarily to extend a full circle of the grip 1. The terminal point 16 of the groove 13 or grooves 13*a*, 13*b* is preferably a recessed area 17 on the wall 11. That is, the first and the second groove 13*a*, 13*b* preferably have terminal points 16 that communicate with each other and together form a recessed area 17, so that the hook 2, which is mounted in the recessed area 17 at the terminal point 16 and has a curved outer surface the same as that of the wall 11, does not radially project from the wall 11 for the grip 1 to have a smooth appearance.

As mentioned above, the hook 2 is mounted in the recessed area 17 at the terminal point 16 of the groove 13 or grooves 13*a*, 13*b* on the grip 1. The hook 2 may be integrally formed on the grip 1, or separately formed and then fixed to the grip 1 using a fixing element, such as a screw, or some type of bonding agent (not shown). The hook 2 is adapted to hold a turning section 37 of the elastic strap 3 thereto. To avoid the elastic strap 3 from easily moving out of the hook 2, the hook 2 is provided at a lower end with a claw 21 pointing toward the grip 1, so that the turning section 37 of the elastic strap 3 may be smoothly slid into the hook 2 without easily separating from the hook 2 via a gap between the claw 21 and the wall 11 of the grip 1. The lower end of the hook 2, that is, the claw 21, is slightly elastic to facilitate moving of the elastic strap 3 into and out of the hook 2.

The elastic strap 3 is connected at an inner end 31 to the grip 1. In the illustrated first embodiment, the elastic strap 3 is connected to the grip 1 by radially outward extending an outer end 32 of the strap 3 through the through hole 12 on the grip 1, and then connecting a diametrically expanded stopper 33 to the inner end 31 of the strap 3 so as to retain the inner end 31 of the strap 3 to an inner side of the grip 1. The outer end 32 of the elastic strap 3 located outside the grip 1 forms a loop portion 34, which includes a first and a second strap section 35, 36, and a turning section 37 located between the first and the second strap section 35, 36 to integrally connect the two sections 35, 36 together.

For the elastic strap 3 to more firmly connect to the grip 1, a washer 4 is further provided at the inner side of the wall 11 corresponding to the through hole 12 on the grip 1, so that the radially outward extended elastic strap 3 first passes through the washer 4 and then the through hole 12.

Figure 4:
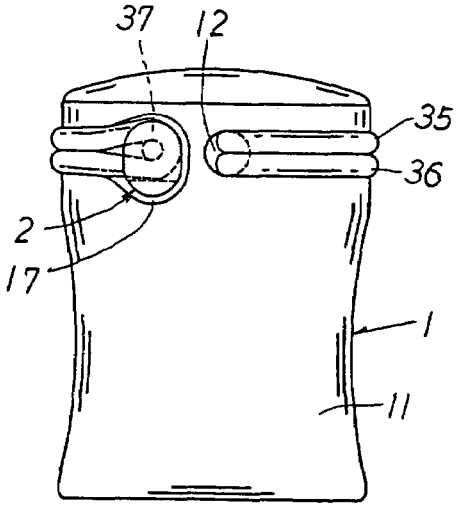
FIG. 4 is a front view of the tangle-free umbrella grip of the present invention shown in FIG. 1 with an elastic strap wound around the grip.
Figure 5:
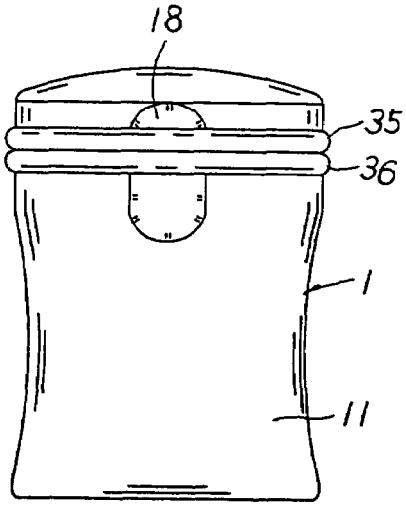
FIG. 5 is a rear view of the tangle-free umbrella grip of the present invention shown in FIG. 1 with the elastic strap wound around the grip.

Please refer to FIGS. 4 and 5 at the same time. When the umbrella is not in use or must be temporarily put aside, a user may, for example, position it in a handbag carried along with the user. Before doing so, the user may first elastically and fitly wind the first and the second strap section 35, 36 of the loop portion 34 of the elastic strap 3 around the first and the second groove 13*a*, 13*b* on the grip 1, and then firmly engage the turning section 37 with the hook 2. Since the initially protruded loop portion 34 of the elastic strap 3 is now fitly wound around the grip 1, the elastic strap 3 would not in any way tangle with any other things in the handbag. The boundary ridge 14 located between the first and the second groove 13*a*, 13*b* serves to guide the first and the second strap section 35, 36 into corresponding grooves 13*a*, 13*b*, respectively, so that the strap sections 35, 36 do not cross with each other to allow the grip 1 to have an outer surface as smooth and even as possible.

A finger cavity 18 is provided on the outer surface of the wall 11 of the grip 1 to axially extend at two ends beyond the first and the second groove 13*a*, 13*b*. When it is desired to release the elastic strap 3 from the wound position on the grip 1 for use, the user may extend a finger into the finger cavity 18 to conveniently pull the elastic strap 3 out of the grooves 13*a*, 13*b*.

Figure 6:
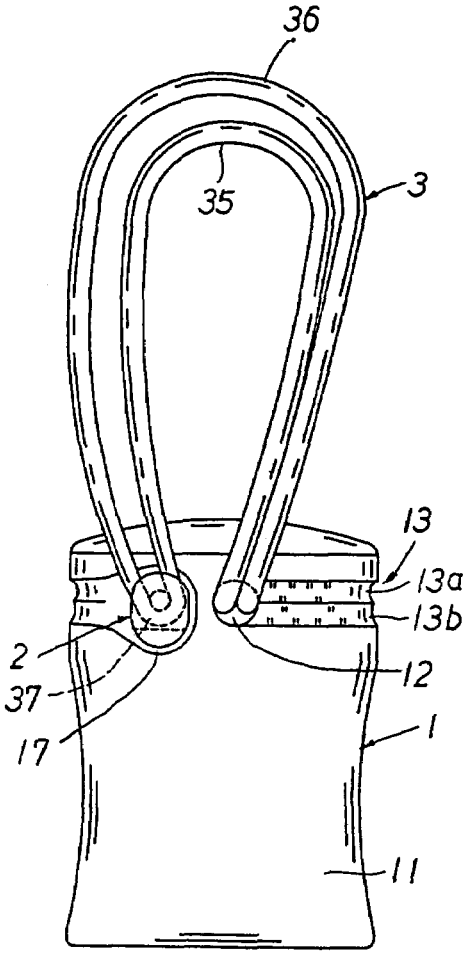
FIG. 6 is a front view of the tangle-free umbrella grip of the present invention shown in FIG. 1 with the elastic strap being turned to engage a free end thereof with a hook provided on the grip.
Figure 7:
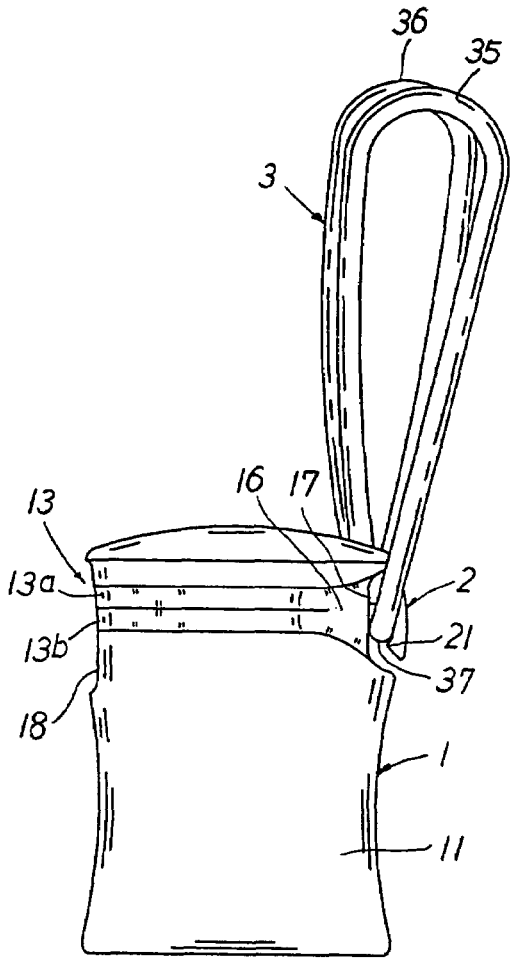
FIG. 7 is a side view of FIG. 6.
Figure 8:
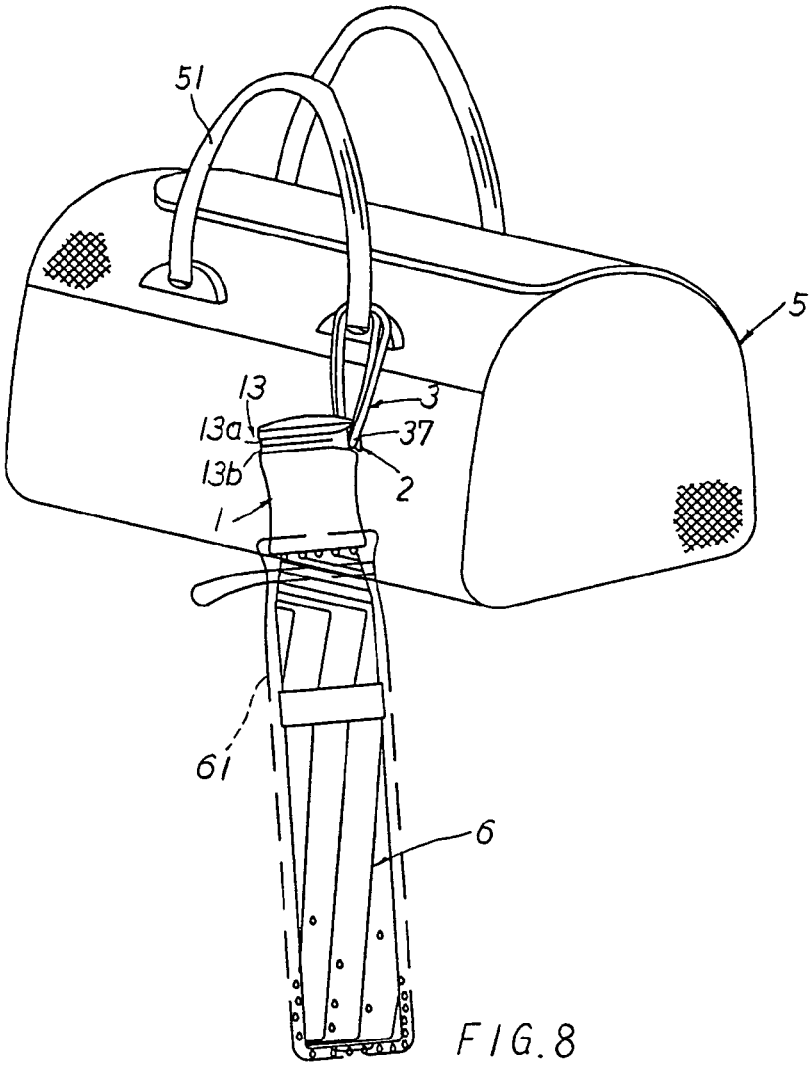
FIG. 8 shows the free end of the elastic strap on the tangle-free umbrella grip of the present invention is extended through a top handle of a handbag and then turned to engage with the hook on the grip.

FIGS. 6, 7, and 8 together shows the manner of hanging the umbrella grip of the present invention to a closed item. In the illustrated drawings, the closed item is a top handle 51 having two ends fixedly and immovably connected to the handbag 5. As can be most clearly seen from FIG. 8, an umbrella 6 with the grip 1 of the present invention is hung to the top handle 51 of the handbag 5 via the elastic strap 3. If necessary, the umbrella 6 may be positioned in a waterproof case 61.

To hang the umbrella 6 to the top handle 51 of the handbag 5, simply extend a free end, that is, the turning section 37 of the elastic strap 3 through the top handle 51, and then turn and engage the turning section 37 with the hook 2 on the grip 1. In this manner, the umbrella 6 could be externally hung to the top handle 51 of the handbag 5 carried along with the user via the elastic strap 3 without wetting items in the handbag 5.

Figure 9:
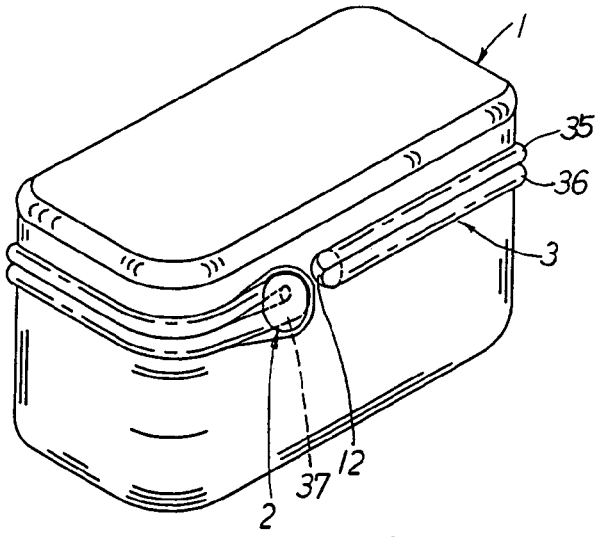
FIG. 9 is a perspective view of a tangle-free umbrella grip adapted for hanging to a closed item according to a second embodiment of the present invention.

FIG. 9 shows a tangle-free umbrella grip adapted for hanging to a closed item according to a second embodiment of the present invention. The umbrella grip in this embodiment is structurally and functionally similar to that in the first embodiment, except that it has a rectangular cross section.

With the present invention, a user may optionally select to put an umbrella not in use in something carried along with the user, such as a handbag, or externally hang the umbrella to the carried handbag or an object near at hand. When the umbrella with the grip of the present invention is put in, for example, a handbag, the elastic strap wound around the grip would not tangle other small items or articles in the handbag and allows the grip and accordingly, the whole umbrella have a neat and beautiful appearance. Since the umbrella is hung to a top handle of the user's handbag or the like or any fixed thing near at hand by extending the turning section or the outer end of the elastic strap through the top handle of the handbag or the fixed thing and then turning the elastic strap to engage the turning section with the hook on the grip, the top handle of the handbag or the thing for holding the elastic strap could be any closed item having two fixed and immovable ends.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A tangle-free umbrella grip adapted for hanging to a closed item, said umbrella grip being connected to a lower end of a central shaft of an umbrella and comprising: a grip formed at an outer periphery with a circumferentially extended wall, and having a through hole extended through said wall; said grip being circumferentially provided on said wall with at least one annular groove, which has a start point communicating with said through hole and a terminal point; a hook located at said terminal point of said at least one groove on said grip; and an elastic strap having an inner end pressing against an inner side of said through hole on said grip, and an outer end outward extended through said through hole to form a loop portion protruded from said grip; said loop portion including a first strap section, a second strap section, and a turning section located between and integrally connecting said first and second strap section together; said elastic strap being adapted to wind around said grip with said first and said second strap section elastically and fitly lying in said at least one groove and said turning section engaged with said hook, allowing said umbrella to be positioned in a container without the trouble of having an elastic strap tangling other items in the container; and said elastic strap also being adapted to hang to a closed item by extending said elastic strap through said closed item and then engaging said turning section at the outer end of said elastic strap with said hook on said grip; wherein said grip is provided with two circumferentially, coaxially, and juxtapositionally arranged annular grooves, namely, first and second grooves; and said first and said second strap section of said elastic strap being respectively elastically and fitly wound around said first and said second groove with said turning section engaged with said hook.

2. The tangle-free umbrella grip adapted for hanging to a closed item as claimed in claim 1, wherein said terminal point of said at least one groove is formed into a recessed area.

3. The tangle-free umbrella grip adapted for hanging to a closed item as claimed in claim 1, wherein said first and said second groove have terminal points communicating with each other and together forming a recessed area.

4. The tangle-free umbrella grip adapted for hanging to a closed item as claimed in claim 1, wherein said hook is integrally formed on said grip.

* * * * *